US005221054A

United States Patent [19]

Bergmann et al.

[11] Patent Number: 5,221,054

[45] Date of Patent: Jun. 22, 1993

[54] ROTOR FOR USE IN IMPACT CRUSHERS

[75] Inventors: Werner Bergmann, Münster; Volker Heukamp, Lengerich; Gerhard Hemesath, Havixbeck, all of Fed. Rep. of Germany

[73] Assignee: Salzgitter Maschinenbau GmbH, Dülman, Fed. Rep. of Germany

[21] Appl. No.: 662,010

[22] Filed: Feb. 28, 1991

[30] Foreign Application Priority Data

Mar. 1, 1990 [DE] Fed. Rep. of Germany ..... 4006329

[51] Int. Cl.[5] ..... B02C 13/28

[52] U.S. Cl. ..... 241/192; 241/286

[58] Field of Search ..... 144/174, 230; 407/45, 407/49; 241/189 R, 192, 195, 294, 286, 259.2, 191, 189.1; 83/698

[56] References Cited

U.S. PATENT DOCUMENTS

| | | | |
|---|---|---|---|
| 3,784,117 | 1/1974 | Koenig et al. | 241/191 |
| 4,275,852 | 6/1981 | Asplund | 241/259.2 |
| 4,594,928 | 6/1986 | Thomas et al. | 144/230 X |
| 4,720,052 | 1/1988 | Hasenfuss et al. | 241/192 |
| 4,922,977 | 5/1990 | Colton et al. | 144/174 X |
| 5,004,169 | 4/1991 | Ostergaard | 241/192 |

FOREIGN PATENT DOCUMENTS

| | | | |
|---|---|---|---|
| 3521588 | 12/1986 | Fed. Rep. of Germany . | |
| 22546 | 1/1962 | German Democratic Rep. | 144/174 |

*Primary Examiner*—Mark Rosenbaum
*Assistant Examiner*—Kenneth J. Hansen
*Attorney, Agent, or Firm*—Horst M. Kasper

[57] ABSTRACT

A rotor which is to be used in an impact crusher has a set of coaxial discs with radially inwardly extending peripheral recesses for elongated beater bars which are parallel to the rotor axis and each of which extends into a discrete recess of each disc. The beater bars have male or female detent elements which cooperate with complementary female or male detent elements of the discs at the rear sides of the beater bars to prevent radially outward movements of the beater bars in actual use of the rotor. The front sides of the beater bars are engaged by wedges which are biased radially outwardly against the beater bars and against the respective discs by fluid-operated thrust elements in the recesses of the discs. Each thrust element has a piston rod which bears against the respective wedge and urges the wedge radially outwardly in the respective recess, and each thrust element reacts against an elongated rail which is installed in the deepmost portions of a set of aligned recesses of the discs. The thrust elements receive pressurized fluid by way of an elongated bore and radially extending ports in the rails which have each a valved connecting member at one axial end. The connecting members are connected to the respective rails by way of a channeled sleeve which surrounds the rotor shaft where it passes the housing wall of the impact crusher, the sleeve shares the rotating movements of the discs.

22 Claims, 1 Drawing Sheet

ROTOR FOR USE IN IMPACT CRUSHERS

CROSS-REFERENCE TO RELATED CASE

Certain features of the rotor which is described, shown and claimed in the present application are described and shown in the commonly owned copending patent application Ser. No. 662,009 filed , Feb. 28, 1991 by Rölf Koning and Gerhard Hemesath for "Rotor for impact crushers or hammer mills".

BACKGROUND OF THE INVENTION

The invention relates to rotors for use in impact crushers and analogous comminuting machines. More particularly, the invention relates to improvements in rotors of the type wherein the body of the rotor supports beater bars which come into contact with the material to be comminuted when the rotor is in use in an impact crusher or in an analogous comminuting machine.

It is known to assemble an impact crusher rotor from several coaxial discs which are mounted on a shaft and the peripheries of which are formed with recesses for reception of beater bars. The beater bars extend in parallelism with the axis of the rotor and are separably coupled to the discs. The means for coupling the beater bars to the discs comprises mating male and female detent elements provided on the rotor body and on the beater bars, and wedges which are disposed at the opposite sides of the beater bars and serve to prevent separation of male and female detent elements when the rotor is in use. The wedges are urged against the respective beater bars by fluid-operated thrust elements. All thrust elements for a set of wedges which engage a particular beater bar receive pressurized fluid from a common conduit which extends in substantial parallelism with the axis of the rotor. Each conduit receives pressurized fluid from a discrete connecting member which is equipped with a regulating valve.

Published German patent application No. 21 48 752 discloses an impact crusher wherein the body of the rotor is formed with integral conduits in the form of bores which convey pressurized fluid to the thrust elements for the wedges. Each conduit includes an axially extending bore which receives pressurized fluid from the main source, and radially extending bores which convey fluid from the axially extending bore to the thrust elements for the respective set of wedges. A drawback of the just outlined conventional rotor is that pressurized fluid is likely to leak at the discharge ends of the radially extending bores as a result of severe shocks to which the beater bars, the wedges and the thrust elements are subjected in actual use of the rotor. The repair of leaks is costly and lengthy with prolonged idleness of the entire impact crusher. Moreover, the drilling of holes or bores into the body of the rotor is a costly procedure which contributes significantly to the initial cost of the rotor.

Published German patent application No. 35 21 588 discloses a modified rotor which can be used in an impact crusher and wherein the wedges are provided with holes or bores for admission of pressurized fluid to the respective thrust elements. The thrust elements include pistons which are installed and are reciprocable in radially inwardly extending transverse holes drilled into the wedges. Pressurized fluid causes the pistons to bear against the body of the rotor and to thereby urge the wedges against the respective beater bars as well as against the body of the rotor.

A drawback of the just described rotor is that it must employ axially elongated wedges each of which extends along not less than one-half of the length of the rotor body. The reason is that each wedge (which has a fluid-supplying bore therein) must carry several pistons which are caused to bear against the rotor body in order to maintain the wedge in clamping position, i.e., to prevent disengagement of mating male and female detent elements which are provided on the beater bar and on the adjacent portion of the rotor body. An elongated wedge does not properly engage a beater bar because the beater bars are cast and have therefore a poor degree of accuracy. Moreover, the wedges are closely adjacent the periphery of the rotor body so that they are subjected to extensive wear and to pronounced shocks in actual use of the rotor. Therefore, these costly wedges must be replaced at frequent intervals with attendant increase of the maintenance cost.

OBJECTS OF THE INVENTION

An object of the invention is to provide a novel and improved rotor which can be used in impact crushers or in analogous machines and can stand longer periods of uninterrupted use than heretofore known rotors.

Another object of the invention is to provide the rotor with novel and improved means for releasably coupling beater bars to the body of the rotor.

A further object of the invention is to provide a novel and improved system for supplying pressurized fluid to thrust elements which serve to bias wedges into engagement with the respective beater bars and with the body of the rotor in an impact crusher.

An additional object of the invention is to provide a rotor-independent pressure line system for admission of pressurized fluid to the thrust elements for wedges which bear upon the respective beater bars to prevent radial and/or other displacements of beater bars relative to the rotor body.

Still another object of the invention is to provide a rotor which can stand extensive wear without damage to its fluid-conveying system and which can be produced and assembled at a fraction of the cost of presently known and used rotors for use in impact crushers and analogous comminuting machines.

SUMMARY OF THE INVENTION

The invention is embodied in a rotor which can be used in an impact crusher and comprises a cylindrical body rotatable about a predetermined axis and having peripheral axially parallel cutouts. The rotor further comprises a beater bar having a first portion received in a cutout and a second portion extending from the cutout, and means for releasably coupling and locking the first portion of the beater bar to the body. In accordance with a presently preferred embodiment, the coupling means includes mating complementary male and female detent elements (e.g., teeth and matching tooth spaces) provided on the body and the first portion at one side of the beater bar, wedges which are provided in the cutout at the other side of the beater bar, and means for biasing the wedges against the beater bar and against the body to thereby prevent disengagement of the male and female detent elements. The biasing means includes a source of pressurized fluid (e.g., oil) having a conduit disposed in the inner portion of the cutout and defining a fluid-conveying passage, and fluid-operated thrust elements (e.g., cylinder and piston units) which receive pressurized fluid from the passage to react against the conduit and to bear against the wedges so that the wedges are urged against the body and against the beater bar and the conduit is urged against the body. The conduit is a bore in an elongated rail, and the thrust elements are disposed radially outwardly of the rail and radially inwardly of the wedges.

The body of the rotor can comprise a plurality of interconnected coaxial discs having aligned peripheral cutouts which together constitute a cutout for a beater bar.

The cutouts include a flank which is spaced apart from and inclined relative to (i.e., not parallel with) the flank on the other side. The wedges then taper radially outwardly with respect to the rotor and have a first surface engaging one of the flanks and a second surface engaging the beater bar.

The thrust elements are preferably connected with the rail so that the rail and the thrust elements can be jointly inserted into or withdrawn from the cutout.

The inner portion of the cutout preferably includes a groove which is provided in the body of the rotor or in the discs and is configurated in such a way that at least certain portions of the rail are fit therein.

The rotor preferably further comprises check valves or one-way valves which are installed between the thrust elements and the passage in the rail to prevent return flow of fluid from the thrust elements into the passage.

The rotor further comprises means for supplying pressurized fluid to the passages in the rails, and such supplying means can include a valve at one axial end of every rail. The rotor is mounted on a shaft which defines the axis of rotation and is surrounded by the housing of the crusher. The means for supplying pressurized fluid to the passages of the rails in the cutouts of the body can further comprise a sleeve which rotates with the body and surrounds the shaft where the shaft projects through the housing wall. The sleeve has channels with a fluid-discharging first end inside of the housing in communication with the passages and a fluid-receiving end outside of the housing. Pipes or flexible hoses can be provided to connect the fluid-discharging ends of the channels in the sleeve with the passages in the rails. There may be arranged outside of the housing means for monitoring the pressure of fluid in the channels.

The novel features which are considered as characteristic of the invention are set forth in particular in the appended claims.

DESCRIPTION OF PREFERRED EMBODIMENTS

Figure 1:
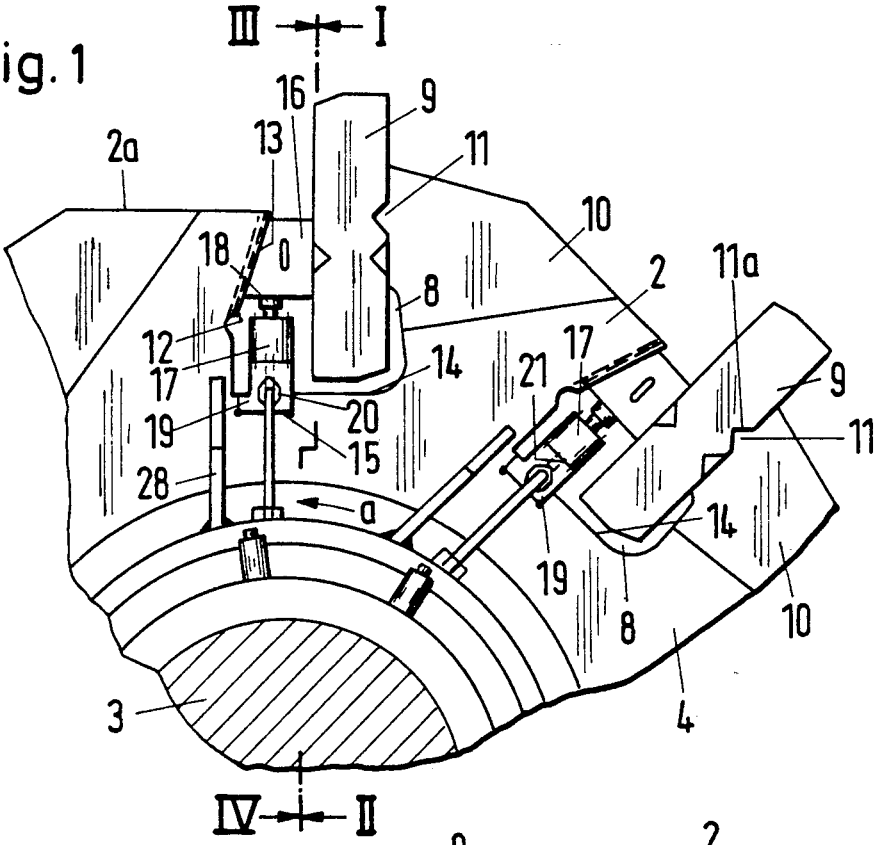
FIG. 1 is a fragmentary end elevational view of a rotor which embodies one form of the invention, the housing of the impact crusher and certain other parts being omitted in FIG. 1 for the sake of clarity.

The rotor 2 which is shown in the drawing is intended for use in an impact crusher for rock, coal or other materials and comprises a rotary body assembled of several coaxial discs 4 which are disposed end-to-end and are rotatable about the axis of a shaft 3. The impact crusher has a housing 1 (only one end wall of such housing can be seen in FIG. 2) which confines the rotor body which is composed of discs 4. Several elongated beater bars 9 are removably coupled to the discs 4 in accordance with a feature of the present invention. The end portions of the shaft 3 extend from the housing 1.

The discs 4 of the rotor body preferably consist of cast steel and have abutting hubs 5 which are mechanically coupled to each other by axially parallel combined locating and centering bolts 6 and are bonded to each other by annular welded seams 7. The ends of the body including the welded-together discs 4 are connected to the shaft 3.

The peripheral surface **2*a* of each disc 4 is provided in the shown embodiment with six equidistant recesses 8 each having a radially inner portion 14 and an open outer portion. The recesses 8 of the discs 4 are aligned in the axial direction of the shaft 3 so that each set of several aligned recesses 8 (it being assumed that of the rotor only a part is shown) constitutes a socket which is parallel to the axis of the shaft 3 and receives a beater bar 9. Each beater bar 9 extends radially outwardly from its socket. The number of sockets in the body of the rotor 2** can be more or less than six.

When the impact crusher is in use, the shaft 3 is assumed to rotate with the rotor 2 in a counterclockwise direction, as seen in FIG. 1 (note the arrow a).

The means for releasably coupling each beater bar 9 to the body of the rotor 2 comprises mating male and female detent elements 11 and **11*a* which constitute ribs and complementary grooves and are respectively provided in the discs 4 and in both sides of the beater bars 9. The coupling means further comprises one wedge 16 for each recess 8 of each disc 4 and means for biasing each wedge against the front side (as respects to the rotating direction of the rotor) of the respective beater bar 9 as well as against a flank 12 of the respective recess 8. The teeth 11 are provided on radially outermost portions or jaws 10 of the respective discs 4**.

The flanks 12 are inclined relative to the front sides of the adjacent beater bars 9, and the wedges 16 taper radially outwardly, i.e., away from the axis of the shaft 3. The means for biasing the wedges 16 radially outwardly comprises an elongated rail 19 which is disposed in the radially inner portions 14 of the respective recesses 8 and fluid-operated thrust elements 17 (e.g., hydraulic cylinder and piston units) which react against the respective rail 19 and thereby urge the wedge 16 against the adjacent flank 12 as well as against the front side of the adjacent beater bar 9.

The flanks 12 of the discs 4 are provided with radially outwardly extending guide elements 13 (e.g., in the form of grooves) for complementary ribs or otherwise configurated projections of the adjacent wedges 16. The guide elements 13 confine the adjacent wedges 16 to movements substantially radially with respect to the shaft 3, either radially inwardly to permit extraction of the respective beater bars 9 from their sockets or radially outwardly to engage the front sides of the beater bars and to thus prevent disengagement of the female detent elements **11*a* at the rear sides of the beater bars from the male detent elements 11 on the respective jaws 10 of the discs 4**.

The radially inner portions 14 of the recesses 8 in the discs 4 include axially parallel grooves 15 which are machined into the respective discs 4 and are configurated and dimensioned in such a way that a part of the radially inner portion of each rail 19 is a fit in the respective grooves 15 of the discs 4.

The thrust elements 17 have radially movable piston rods 18 which can be caused to bear against the radially inner sides of the respective wedges 16 when the cylinders of the thrust elements receive pressurized hydraulic fluid from composite fluid-conveying passages of the respective rails 19. The illustrated rails 19 have a polygonal cross-sectional outline and are mounted in parallelism with the axis of the shaft 3 and rotor body including the discs 4. Each passage includes an elongated bore 20 which is machined into and extends longitudinally of the respective rail 19, and a plurality of radially outwardly extending ports 21 which communicate with the bore 20 and serve to admit pressurized hydraulic fluid into the respective thrust elements 17. Such pressurized fluid causes the pistons in the cylinders of the respective thrust elements 17 to move their piston rods 18 radially outwardly and to thus clamp the respective wedges 16 between the flanks 12 and the front sides of the beater bars 9. It will be seen that the rails 19 are disposed radially inwardly of the respective thrust elements 17 and that the thrust elements 17 are disposed radially inwardly of the respective wedges 16. This ensures that, when the bores or ports 20, 21 admit pressurized fluid to the respective thrust elements 17, the thrust elements (indirectly) react against the body of the rotor 2 by way of the respective rails 19 and ensure that the wedges 16 are urged against the body of the rotor 2 (i.e., against the flanks 12 of the respective discs 4) as well as against the adjacent beater bars 9 to prevent any radially outward movement of the beater bars in that the female detent elements 11*a* are held in engagement with the complementary male detent elements 11 of the jaws 10.

A check valve 50 can be installed in each port 21 or in the adjacent portion of the respective thrust element 17 to prevent return flow of fluid from the cylinders of the thrust elements into the bores or holes 20 of the respective rails 19.

The illustrated wall of the housing 1 of the impact crusher a part of which is the rotor 2 can be provided with closable windows which are adjacent the respective ends of the rails 19 and afford access to valves in connecting members. The valves can be manipulated to establish or terminate communication between the bores 20 and a manually operated pressure pump.

The shaft 3 is surrounded by a sleeve 24 which extends from outside into the housing 1 and is provided with channels 23, one for each rail 19. The fluid-discharging ends of the channels 23 are communicatively connected with the adjacent ends of the bores 20 in the respective rails 19 by flexible hoses or by rigid pipes 22, and the fluid-receiving ends of the channels 23 are in communication with the respective connecting members 25 which are installed externally of the housing 1 and contain regulating valves, not shown. The main source of pressurized fluid can include a manually operated or motor-driven pump which draws fluid from a sump.

The pressure of fluid in the channels 23 is monitored by pressure gauges 26, one for each rail 19. The pressure gauges 26 cooperate with signal generating sensors 27 which transmit signals when the pressure in the respective channels 23 drops below a predetermined minimum acceptable value.

Figure 2:
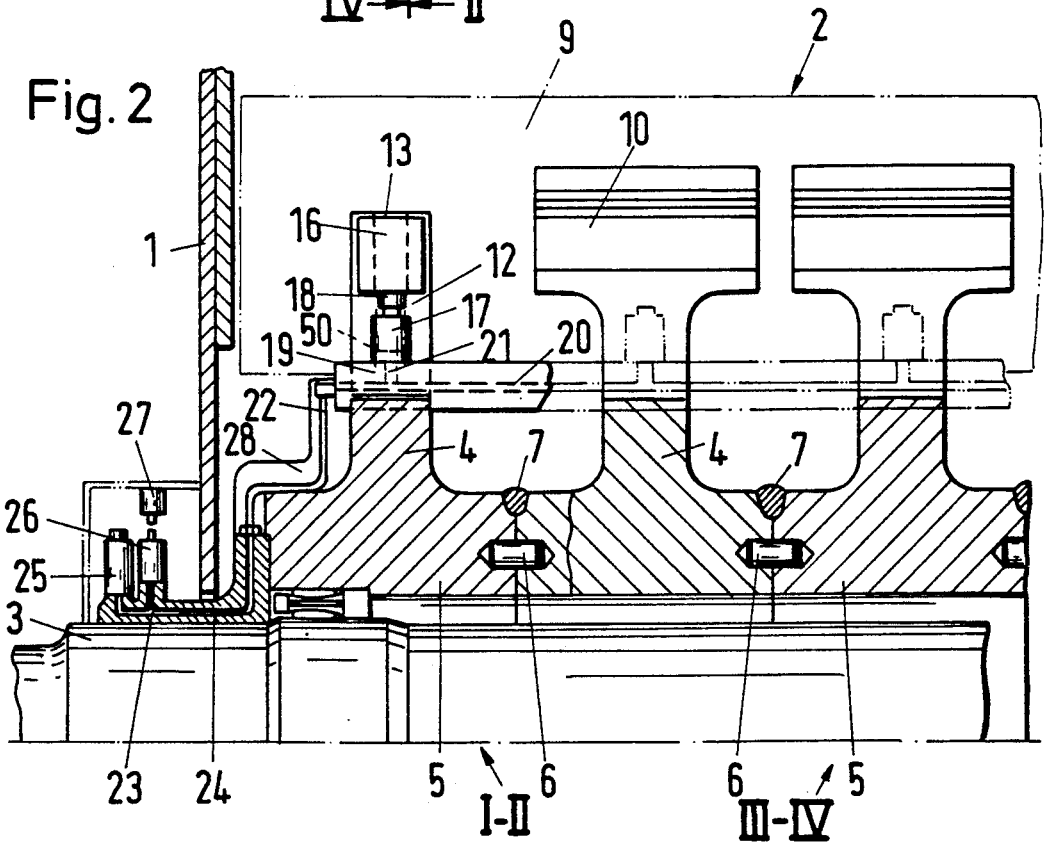
FIG. 2 is a composite fragmentary axial sectional view of the rotor, in part as seen in the direction of arrows from the line I-II and in part as seen in the direction of arrows from the line III-IV in FIG. 1.

The leftmost disc 4 of FIG. 2 carries webs 28 which are provided ahead of the adjacent ends of the rails 19 to protect the pipes or hoses 22 from damage when the rotor 2 is in actual use.

The connecting members 25 are used in lieu of connecting members in the housing 1 at the ends of the bores 20. If the connecting members are installed in the housing 1, the latter is provided with the aforementioned windows or with doors to afford access to such connecting members.

An important advantage of the improved rotor is that its fluid-conveying or supplying system is less expensive but more reliable and longer-lasting than the fluid-conveying systems of the aforediscussed conventional rotors. The rails 19 can be fabricated from commercially available semifinished steel blanks. Moreover, a damaged rail 19 can be readily removed and replaced with an intact rail with little loss in time. Still further, and in contrast to the construction of the rotor which is described in the aforementioned published German patent application No. 35 21 588, the improved rotor can employ axially short wedges, one for each recess or cutout 8 in each disc 4. Short wedges which do not extend axially beyond the respective recesses 8 in the corresponding discs 4 are desirable and advantageous because they are completely shielded by the rotor discs and thus protected against wear. A relatively short wedge is much more likely to lie flush against the beater bar than a wedge having a length in excess of one-half the axial length of the rotor body because a beater bar is an inaccurate casting.

Another important advantage of the improved rotor 2 is that those parts of the fluid-conveying rails 19 which are located between the rotor discs are subjected to a lesser amount of wear, since they are nearer to the axis of the rotor where there is little penetration of material to be crushed so that they can stand long periods of use.

The rails 19 need not be anchored in and/or otherwise fixedly connected to the discs 4, except that they are preferably held against axial movement relative to the rotor body. Radial shifting of the rails 19 is prevented in a fully automatic way when the improved rotor is in use because the thrust elements 17 react against and push the respective rails 19 radially inwardly into the respective grooves 15 while the piston rods 18 of the thrust elements bear against the respective wedges 16. The grooves 15 perform the additional desirable function of guiding the rails 19 during extraction from or introduction into the recesses 8 of the discs 4 when the beater bars must be exchanged.

The check valves 50 exhibit the advantage that an operative thrust element 17 continues to exert a required pressure upon the adjacent wedge 16 even if a leak develops in the passage 20, 21 of the respective rail 19. Such check valves permit admission of pressurized fluid into but prevent escape of admitted fluid from the cylinders of the respective thrust elements 17.

Accessibility of connecting members 25 at one axial end of the rotor 2 renders it possible to rapidly admit pressurized fluid into the passage 20, 21 of a selected rail 19 when the corresponding signal generating sensor 27 indicates that the pressure of fluid in the corresponding channel 23 of the sleeve 24 is too low. As mentioned above, pressurized fluid can be admitted by a manually operated pump or in any other suitable way. The connecting members 25 can be provided within the housing 1 (the housing is then provided with windows or doors to afford access to the connecting members) or (as shown) at the exterior of the housing.

An advantage of the sleeve 24 is that it renders it possible to avoid the drilling of holes in the shaft 3. The cost of providing the sleeve 24 with a requisite number of suitably configurated channels 23 is a small fraction of the cost of drilling channels into the rotor shaft 3. The ends of the channels 23 in the sleeve 24 can contain nozzles which facilitate connection of the properly installed sleeve 24 to the conduits or pipes 22 and to the connecting members 25. For example, the nozzles at the fluid-receiving ends of the channels 23 can be provided with internal or external threads to mate with complementary threads of the respective connecting members 25.

The pressure gauges 26 can be operated by springs or in any other conventional manner. The springs can displace mobile portions of the orbiting gauges 26 when the pressure in the respective channels 23 drops below a preselected minimum acceptable pressure so that the displaced portions of the gauges 26 then actuate the respective sensors 27 to generate signals which are detected by an attendant who replenishes the supply of pressurized fluid in the respective rail 19.

The improved rotor 2 is susceptable of numerous additional modifications without departing from the spirit of the invention. For example, the number of discs 4 in the rotor body can be increased or reduced, the number of recesses 8 in each disc 4 can be increased or reduced, the shape of the male and female detent elements can be altered, and the pressure gauges 26 can be modified to embody discrete signal generators so that the stationary sensors 27 can be dispensed with.

Without further analysis, the foregoing will so fully reveal the gist of the present invention that others can, by applying current knowledge, readily adapt it for various applications without omitting features that, from that standpoint of prior art, fairly constitute essential characteristics of the generic and specific aspects of our contribution to the art and, therefore, such adaptations should and are intended to be comprehended within the meaning and range of equivalence of the appended claims.

We claim:

1. An impact crusher rotor comprising a cylindrical body rotatable about a predetermined axis and having peripheral axially parallel cutouts;

a beater bar having a first portion received in one of said cutouts and a second portion extending from said cutouts; and means for releasably coupling said first portion of said beater bar to said body, including mating complementary male and female detent elements provide on said body and on said first portion at one side of said beater bar, wedges provided in said cutout at the other side of said beater bar, and means for biasing said wedges against said beater bar and said body to thereby prevent disengagement of said male and female detent elements, said biasing means including a source of pressurized fluid having a conduit disposed in the inner portions of said cutouts and defining a fluid-conveying passage, and fluid-operated thrust elements which receive pressurized fluid from said passage to react against said conduit and to bear against said wedges so that the wedges are urged against said body and against said beater bar and said conduit is urged against said body, said conduit being a bore in an elongated rail and said thrust elements being disposed radially outwardly of said rail and radially inwardly of said wedges.

2. The rotor of claim 1, wherein said body comprises a plurality of interconnected coaxial discs having a aligned peripheral cutouts.

3. The rotor of claim 1, wherein said inner portion of said cutouts includes a groove which is provided in said body and said rail is a fit in said groove.

4. The rotor of claim 2, further comprising a check valve provided between said thrust elements and said passage in said rail to prevent return flow of fluid from said thrust elements into said passage.

5. The rotor of claim 1, wherein said thrust elements are connected with said rail so that said rail and said thrust elements can be jointly inserted into or withdrawn from said cutouts.

6. The rotor of claim 1 wherein said biasing means further comprises means for supplying pressurized fluid to said passage, said supplying means including a valve at one axial end of said body.

7. The rotor of claim 1, further comprising a shaft for said body and a housing for said body, said biasing means further comprising means for supplying pressurized fluid to said passage and said supplying means including a sleeve surrounding said shaft and extending from outside into said housing and arranged to rotate with said body, said sleeve having channels with fluid-discharging ends communicating with said passages and fluid-receiving ends outside of said housing.

8. The rotor of claim 7, wherein said supplying means further comprises a pipe or hose connecting the fluid-discharging end of said channel with said passage.

9. The rotor of claim 7, further comprising means for monitoring the pressure of fluid in said passage.

10. The rotor of claim 7, wherein said monitoring means is located outside of said housing.

11. The rotor according to claim 1, further comprising a second beater bar having a first portion received in a second one of the cutouts.

12. An impact crusher rotor comprising a cylindrical body or a body consisting of several axially combined round discs rotatable about a predetermined axis and having peripheral axially parallel cut-outs or series of flushing cutouts in said discs;

beater bars each having a first portion received in said cutouts and a second portion extending from said cutouts; and means for releasably coupling said first portion of said beater bars to said body, including mating complementary male and female detent elements provided on said body and on said first portion at one side of said beater bars, wedges provided in said cutouts at the other side of said beater bars, and means for biasing said wedges against said better bars and said body to thereby prevent disengagement of said male and female detent elements, said biasing means including a source of pressurized fluid having a conduit disposed in every of said cutouts and defining a fluid-conveying passage, and fluid-operated thrust elements which receive pressurized fluid from said passage to react against said conduit and to bear against said wedges to that the wedges are urged against said body and against said beater bars, said conduit being a bore in an elongated rail which is releasably disposed in the inner portion of every cutout, and said thrust elements being disposed radially outwardly of said rail and radially inwardly of said wedges, so that said rail is urged against said body.

13. An impact crusher rotor comprising a cylindrical body including a round disc and rotatable about a predetermined axis;

a plurality of parallel disposed cut-outs extending in an axial direction and distributed over a circular periphery of the cylindrical body;

a plurality of beater bars with each one of the plurality of beater bars having a first portion received in a corresponding cutout of said plurality of cutouts and having a second portion extending from said cutouts in a radially outward direction;

a plurality of first detent elements with each one of the first detent elements associated with and disposed on a corresponding first portion of the plurality of beater bars;

a plurality of second detent elements with each one of the second detent elements associated with and disposed on a corresponding first portion of the plurality of beater bars;

a plurality of third detent elements provided on said body and constructed to be complementary to said plurality of first detent elements and to mate with the plurality of first detent elements;

a plurality of wedges provided in the plurality of cutouts;

a plurality of fourth detent elements provided on said plurality of wedges and constructed to be complementary to said plurality of second detent elements and to mate with the plurality of second detent elements such that a respective one of the plurality of the beater bars and a respective one of the plurality of the wedges are disposed side by side in a respective one of the plurality of parallel disposed cut-outs;

a plurality of fluid-operated thrust elements, wherein each one of the plurality of fluid-operated thrust elements engages a respective one of the plurality of wedges;

a plurality of conduits for pressurized fluid wherein each one of the plurality of conduits is disposed in a respective one of the plurality of cut-outs, wherein each one of the plurality of conduits is connected to a respective one of the plurality of fluid-operated thrust elements, such that upon actuation of the fluid operated thrust elements, each one of said plurality of wedges biased against a respective one of said plurality of beater bars and against said body to thereby prevent disengagement of the plurality of first detent elements from the plurality of third detent elements and to thereby prevent disengagement of the plurality of second detent elements from said plurality of fourth detent elements;

a plurality of biasing means including a source of pressurized fluid and connected to the plurality of conduits for pressurized fluid disposed in every of said cutouts and defining a fluid-conveying passage, wherein the plurality of fluid-operated thrust elements receives pressurized fluid from said fluid-conveying passage to transmit through said plurality of conduits and to bear against said plurality of wedges such that each one of the plurality of the wedges is urged against said body and against a respective one of said plurality of beater bars, wherein each one of said plurality of biasing means includes a bore in an elongated rail and wherein a respective rail is releasably disposed in an inner portion of a respective one of the plurality of cut-outs, and wherein the plurality of thrust elements is disposed radially outwardly of said rail and radially inwardly of said wedges, so that upon actuation of said thrust element, then said rail is urged against said body.

14. The rotor of claim 13, wherein said body comprises a plurality of interconnected coaxially disposed discs having peripheral cutouts aligned in parallel to an axis of said body.

15. The rotor of claim 13, wherein each one of the plurality of said thrust elements is connected to a respective one of said plurality of rails such that a respective one of said plurality of rails and a respective one of said plurality of thrust elements are jointly insertable into or withdrawable from a respective one of said plurality of said cutouts.

16. The rotor of claim 13, wherein each one of the plurality of cutouts includes an inner portion and a groove, wherein a respective one of said plurality of rails is constructed for matching the shape of said groove and for fitting in said groove.

17. The rotor of claim 13 further comprising a check valve provided between said thrust elements and said passage in said rail to prevent return flow of fluid from said thrust elements into said passage.

18. The rotor of claim 13, wherein said biasing means further comprises means for supplying pressurized fluid to said passage, said supplying means including a valve disposed at one axial end of said body.

19. The rotor of claim 13 further comprising a shaft for said body and a housing for said body, said biasing means further comprising means for supplying pressurized fluid to said passage and said means for supplying including a sleeve surrounding said shaft and extending from outside into said housing and arranged to rotate with said body, said sleeve having channels with fluid-discharge ends communicating with said passages and fluid-receiving ends outside of said housing.

20. The rotor of claim 19, wherein said supplying means further comprises a pipe connecting the fluid-discharging end of one channel of said channels with said passage.

21. The rotor of claim 13, further comprising means for monitoring the pressure of fluid in said passage.

22. The rotor of claim 21 further comprising a housing, wherein said means for monitoring is located outside of said housing.

* * * * *